US011317216B2

(12) United States Patent
Gu

(10) Patent No.: US 11,317,216 B2
(45) Date of Patent: Apr. 26, 2022

(54) SPEAKER

(71) Applicant: AAC Technologies Pte. Ltd., Singapore (SG)

(72) Inventor: Xiaojiang Gu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 275 days.

(21) Appl. No.: 16/706,792

(22) Filed: Dec. 8, 2019

(65) Prior Publication Data

US 2020/0204921 A1 Jun. 25, 2020

(30) Foreign Application Priority Data

Dec. 25, 2018 (CN) ..... 201822192184.2

(51) Int. Cl.

| | |
|---|---|
| ***H04R 9/06*** | (2006.01) |
| ***H04R 31/00*** | (2006.01) |
| ***H04R 7/18*** | (2006.01) |
| ***H04R 7/04*** | (2006.01) |
| ***H01R 13/405*** | (2006.01) |
| ***H01R 4/02*** | (2006.01) |
| ***H01R 13/24*** | (2006.01) |

(52) U.S. Cl.

CPC ..... *H04R 9/06* (2013.01); *H01R 4/02* (2013.01); *H01R 13/24* (2013.01); *H01R 13/405* (2013.01); *H04R 7/04* (2013.01); *H04R 7/18* (2013.01); *H04R 31/003* (2013.01); *H04R 2400/11* (2013.01)

(58) Field of Classification Search

CPC ... H04R 9/06; H04R 7/14; H04R 7/18; H04R 31/003; H04R 2400/11; H01R 4/02; H01R 13/24

See application file for complete search history.

(56) References Cited

U.S. PATENT DOCUMENTS

2009/0142961 A1 6/2009 Chen et al.
2015/0201256 A1* 7/2015 Xu ..... H04R 1/06 381/417

FOREIGN PATENT DOCUMENTS

CN 202488525 B1 10/2012
CN 202488525 U * 10/2012
CN 209390329 B1 9/2019

OTHER PUBLICATIONS

PCT search report dated Dec. 30, 2019 by SIPO in related PCT Patent Application No. PCT/CN2019/111284 (4 Pages).

* cited by examiner

*Primary Examiner* — Sunita Joshi
(74) *Attorney, Agent, or Firm* — W&G Law Group

(57) ABSTRACT

The present invention discloses a speaker which has a frame formed by side walls, a vibrating system and two conductive terminals. Each of the conductive terminal includes a soldering sheet, an extending arm, a connecting arm bending and extending from the extending arm and arranged on opposite to the soldering sheet, an elastic arm, and a contacting hook. The two extending arms respectively extend from the two soldering sheets at the sides away from each other. The two connecting arms respectively extend from the two extending arms towards the direction close to each other, and the elastic arms are arranged spaced from the side walls. Compared with the related art, the conductive terminals of the speaker of the present invention have the advantages of strong working elasticity and long service life.

4 Claims, 3 Drawing Sheets

SPEAKER

FIELD OF THE PRESENT INVENTION

The present invention relates acoustoelectric field, and more particularly to a speaker applied to a portable electronic product.

DESCRIPTION OF RELATED ART

With the advent of the mobile Internet era, the number of smart mobile devices is continuously increasing. Among numerous mobile devices, mobile phones are undoubtedly the most common and portable mobile terminal devices. A speaker for playing sound is widely applied to smart mobile devices, such as mobile phone.

In the related art, a speaker includes a frame formed by surrounding side walls, a vibrating system fixed on the frame and two conductive terminals fixed on two opposite side walls of the frame. The vibrating system includes a vibrating diaphragm fixed on the frame and a voice coil for driving the vibrating diaphragm. The voice coil is electrically connected to the conductive terminals. When the conductive terminals is provided with an alternating audio current, the voice coil of the vibrating system is subjected to a alternating driving force in a magnetic circuit system so as to generate an alternating motion, thereby driving the vibrating diaphragm of the vibrating system to vibrate and make sound. The conductive terminal includes a soldering sheet, a connecting arm, an elastic arm and a contacting hook. The connecting arm is formed by bending and extending the soldering sheet at an end away from the contacting hook, the elastic arm is formed by the connecting arm extending along the side wall, and the contacting hook is formed by bending and extending from the elastic arm. The elastic arm is arranged spaced from the soldering sheet.

However, in the related art, the connecting arm of the conductive terminal is bent and extended from an end of the side wall, and the elastic arm is extended from the connecting arm along the side wall towards a direction close to the other end of the side wall. Therefore the length of the conductive arm is too long, which increases a length of a force arm of the conductive terminal, results in a weak working elasticity of the conductive terminal. The elastic arm will easily deform over time so that the contacting hook will occur poor contact and so on. Therefore, the conductive terminal in the related art has the disadvantages of weak working elasticity and short service life.

Therefore, it is necessary to provide a new speaker which can overcome the above-mentioned problems.

BRIEF DESCRIPTION OF THE DRAWINGS

The embodiment of the present invention will be more clearly understood from the following drawings. It is obvious that the following described drawings are only some embodiments of the invention. For the person skilled in the art, he can achieve the other drawings from these drawings without any creative work.

DETAILED DESCRIPTION OF THE EXEMPLARY EMBODIMENT

The technical solution in the embodiments of the invention will be clearly and completely described by combining with the drawings in the embodiments of the invention. Apparently, the described embodiments are only parts of the embodiments of the invention, but not all of the embodiments. Based on these embodiments, all the other embodiments that the person skilled in the art can achieve without making creative work, are belong to the scope of protection of the invention.

Figure 1:
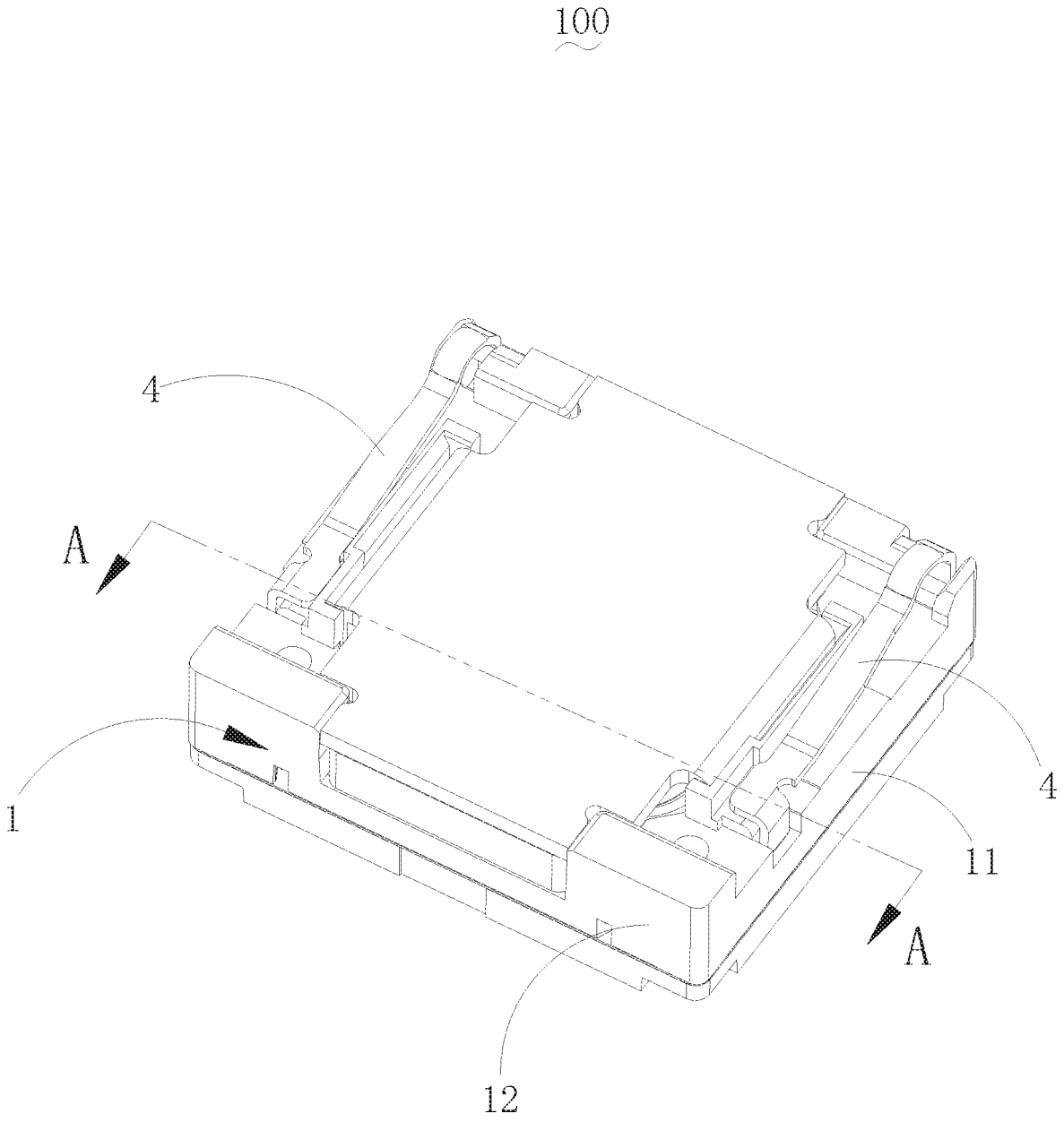
FIG. 1 is an isometric view of a structure of a speaker according to the present invention.
Figure 2:
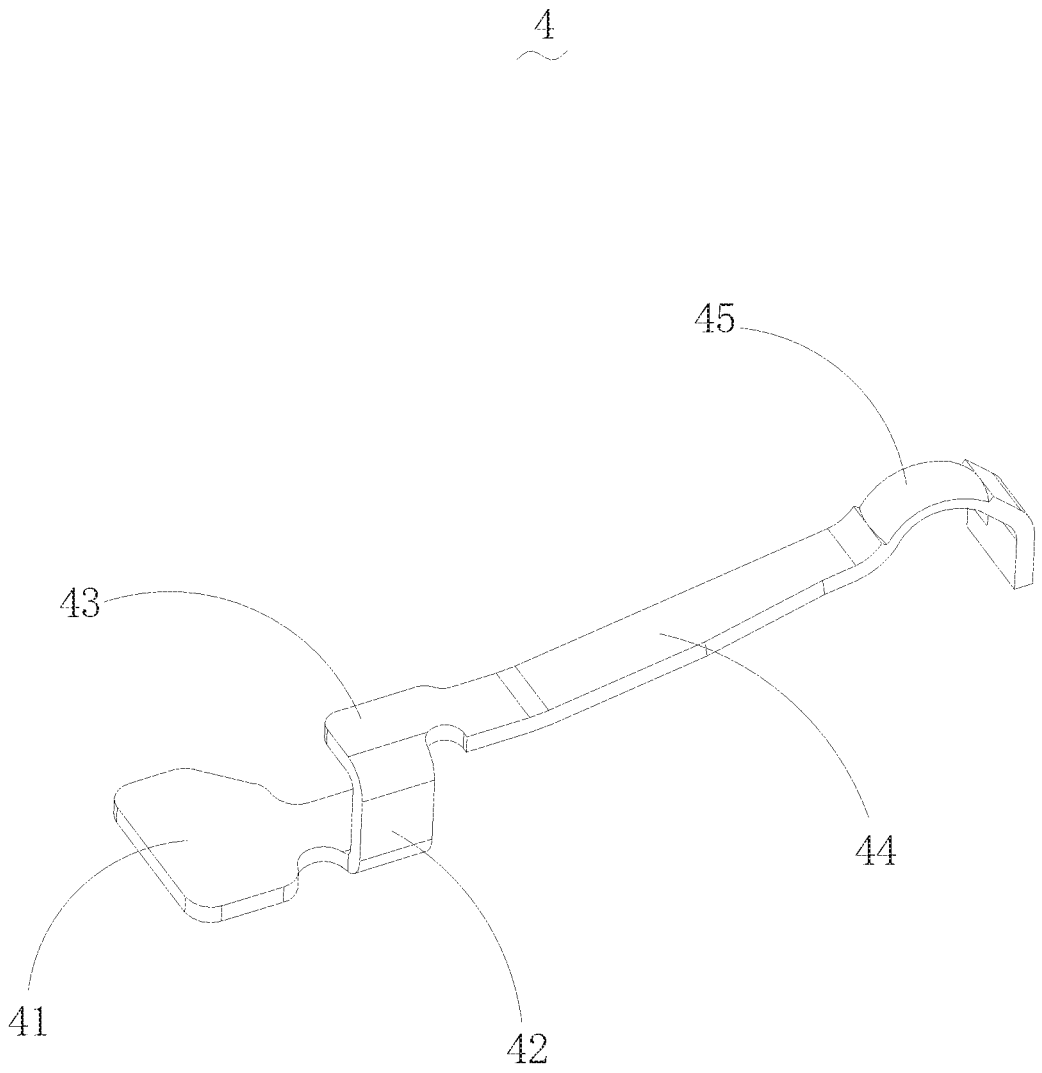
FIG. 2 is an isometric view of a structure of a conductive terminal of the speaker according to the present invention.
Figure 3:
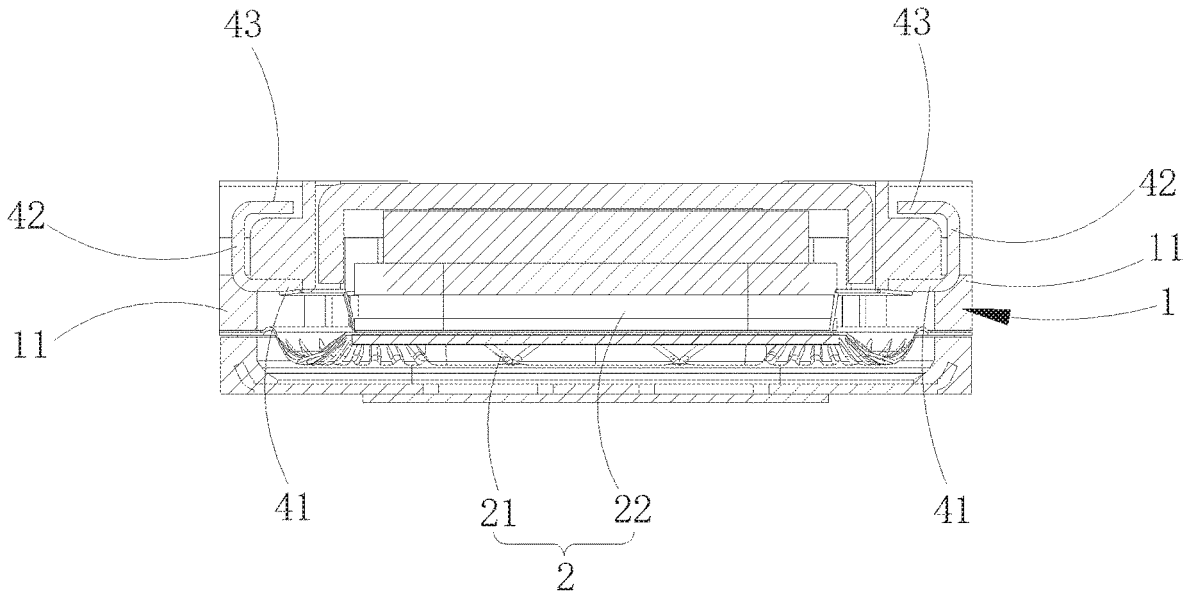
FIG. 3 is a cross-sectional view of the speaker taken along line A-A in FIG. 1.

Referring to FIG. 1 to FIG. 3, the present invention discloses a speaker 100, which includes a frame 1, a vibrating system 2 and conductive terminals 4.

The frame 1 is surrounded and formed by side walls, in this embodiment, the side walls includes two lateral walls 11 arranged opposite to each other and two longitudinal walls 12 arranged opposite to each other. Specifically, the conductive terminals include two, and both of them are fixed on the two opposite side walls of the frame 1. More specifically, the two conductive terminals are fixed on two opposite lateral walls 11 of the frame 1 respectively.

The vibrating system 2 is fixed on the frame 1 and includes a vibrating diaphragm 21 and a voice coil 22 for driving the vibrating diaphragm 21 to vibrate and sound. The voice coil 22 is electrically connected to the conductive terminals 4.

The conductive terminals 4 include a soldering sheet 41 embedded in the lateral wall 11, an extending arm 42 bending by the soldering sheet 41 towards a direction away from the vibrating diaphragm 21 and extending outwards the lateral wall 11, a connecting arm 43 bending and extending from the extending arm 42 and arranged on opposite to the soldering sheet 41, an elastic arm 44 extending from the connecting arm 43 along the lateral wall 11, and a contacting hook 45 bending and extending from the elastic arm 44. The two extending arms 42 of the two conductive terminals 4 respectively extend from the two soldering sheets 41 at the sides away from each other. The two connecting arms 43 respectively extend from the two extending arms 42 towards a direction close to each other, and the elastic arms 44 are arranged spaced from the lateral walls 11.

Since the connecting arm of the conductive terminal in the related art bends and extends from an end of the side wall, the elastic arm extends from the connecting arm along the side wall toward a direction close to the other end of the side wall. However, in the present invention, the two extending arms of the two conductive terminals respectively extend from the two soldering sheets at the side away from each other, the two connecting arms respectively extend from the two extending arms toward the direction close to each other, and the elastic arms are formed by the connecting arms extending along the side walls. Therefore, in the present invention, the length of the elastic arms of the conductive terminals is shorter, and the force arms of the conductive terminals are shorter, the working elasticity is stronger, and the elastic arms will not deform easily and the service life is longer.

In the present embodiment, the extending arm 42 is located on the soldering sheet 41 at the side away from the voice coil 22 and at the end close to the contacting hook 45. Thereby, the length of the elastic arm is further reduced, the working elasticity of the conductive terminal is further improved, and the service life of the conductive terminal is further extended.

Specifically, the connecting arm 43 is mutually parallel to the soldering sheet 41, which is benefit not only for forming the conductive terminal, but also providing more excellent elastic performance.

More specifically, the conductive terminals 4 are integrally fixed on the lateral wall 11 by injection molding so that the conductive terminals are more firmly fixed on the frame 1 to provide a good elastic basic.

When the contacting hook 45 is connected with an external component, the contacting hook 45 is pressed and sway in the direction close to the soldering sheet 41 together with the elastic arm 44. When the contacting hook 45 is disconnected with the external component, the elastic arm 44 will sway, due to an elastic force, in the direction away from the soldering sheet 41 together with the contacting hook 15.

Compared with the related art, the conductive terminal in the speaker of the present invention comprises a soldering sheet embedded in the lateral wall, an extending arm bending by the soldering sheet towards the direction away from the vibrating diaphragm and extending outwards the lateral wall, a connecting arm bending and extending from the extending arm and arranged on opposite to the soldering sheet, an elastic arm extending from the connecting arm along the lateral wall, and a contacting hook bending and extending from the elastic arm. The two extending arms of the two conductive terminals respectively extend from the two soldering sheets at the sides away from each other. The two connecting arms respectively extend from the two extending arms towards the direction close to each other, and the elastic arms are arranged spaced from the lateral walls. Thus the elastic arms are essentially formed by bending and extending a side of the soldering sheets, so the length thereof is shorter. Thereby, the length of force arms of the conductive terminals is reduced, the working elasticity is stronger; the elastic arms will not deform easily and the service life is longer.

The above is only the embodiment of the present invention, and it should be noted that those skilled in the art can still make improvements without departing from the inventive concepts, and these improvements are all belong to the protection scope of the present invention.

What is claimed is:

1. A speaker, comprising a frame surrounded and formed by side walls, a vibrating system fixed on the frame and two conductive terminals fixed on opposite side walls of the frame;

wherein, the vibrating system comprises a vibrating diaphragm fixed on the frame and a voice coil for driving the vibrating diaphragm to vibrate, the voice coil is electrically connected to the conductive terminals;

each of the conductive terminals includes a soldering sheet embedded in the side walls, an extending arm bending by the soldering sheet towards a direction away from the vibrating diaphragm and extending outwards the side wall, a connecting arm bending and extending from the extending arm and arranged on opposite to the soldering sheet, an elastic arm extending from the connecting arm along the side wall, and a contacting hook bending and extending from the elastic arm, wherein the extending arm is located on the soldering sheet at the side away from the voice coil and at the end close to the contacting hook; and the two extending arms of the two conductive terminals respectively extend from the two soldering sheets at the sides away from each other, the two connecting arms respectively extend from the two extending arms towards the direction close to each other, and the elastic arms are arranged spaced from the side walls.

2. The speaker according to claim 1, wherein the connecting arm is mutually parallel to the soldering sheet.

3. The speaker according to claim 1, wherein the side walls include two longitudinal walls arranged opposite to each other and two lateral walls arranged opposite to each other, and the two conductive terminals are respectively fixed on the two lateral walls.

4. The speaker according to claim 1, wherein the conductive terminal is integrally fixed on the side wall by injection molding.

* * * * *